US007237653B2

(12) United States Patent
Chida

(10) Patent No.: US 7,237,653 B2
(45) Date of Patent: Jul. 3, 2007

(54) ELEVATOR CONTROLLER

(75) Inventor: Akihiro Chida, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 364 days.

(21) Appl. No.: 10/526,433

(22) PCT Filed: Nov. 19, 2003

(86) PCT No.: PCT/JP03/14735

§ 371 (c)(1),
(2), (4) Date: Mar. 3, 2005

(87) PCT Pub. No.: WO2005/049467

PCT Pub. Date: Jun. 2, 2005

(65) Prior Publication Data

US 2006/0060427 A1 Mar. 23, 2006

(51) Int. Cl.
*B66B 1/28* (2006.01)

(52) U.S. Cl. ..... 187/248; 187/393

(58) Field of Classification Search ..... 187/247, 187/248, 277, 288, 391–393
See application file for complete search history.

(56) References Cited

U.S. PATENT DOCUMENTS 4,350,225 A * 9/1982 Sakata et al. ..... 187/248
4,567,560 A * 1/1986 Polis et al. ..... 700/79
4,719,993 A * 1/1988 Ujihara ..... 187/247
5,142,107 A 8/1992 Yasuhiro
5,387,769 A * 2/1995 Kupersmith et al. ..... 187/248
5,526,256 A 6/1996 Sakata et al.
5,936,211 A * 8/1999 Kim ..... 187/248
6,173,814 B1 1/2001 Herkel et al.
6,758,319 B1 7/2004 Lange et al.

FOREIGN PATENT DOCUMENTS

JP 04049181 A * 2/1992
JP 2000-255431 9/2000
JP 2002-241062 8/2002

* cited by examiner

*Primary Examiner*—Jonathan Salata
(74) *Attorney, Agent, or Firm*—Leydig, Voit & Mayer, Ltd.

(57) ABSTRACT

Signals sent from detectors through input units are inputted to respective microcomputers. Microcomputers are synchronized with each other by an external clock, and execute input processing and arithmetic operation processing. In addition, a common memory is connected to each of the microcomputers, which read out/write data from/to the common memory through respective buses. In such a manner, each of the microcomputers adopts a simple hardware configuration having the external clock and the common memory which are common to the microcomputers.

4 Claims, 3 Drawing Sheets

ELEVATOR CONTROLLER

TECHNICAL FIELD

The present invention relates to an elevator controller having a multiple redundancy configuration including a plurality of control systems.

BACKGROUND ART

For example, in a multiple redundancy configuration in a safety controller for a railway disclosed in JP 2000-255431 A, a failsafe function can be ensured using a plurality of control systems to improve its reliability. Each of control systems carries out comparison between one's own system and other system using a common memory with respect to input/output results of a signal to/from an on-site device. When the result data disagree with each other, each of the control systems judges that a failure has occurred and causes running of trains on railways to stop.

More specifically, for a certain input contact signal, input results in one's own system (hereinafter referred to as "a system A") and input results in other system (hereinafter referred to as "a system B") are compared with each other as follows. A controller of the system A reads out an input contact signal from an input unit of the system A and writes read-out results to the common memory. On the other hand, a controller of the system B, similarly, reads out an input contact signal from an input unit of the system B and writes read-out results to the common memory.

The controller of the system A reads out, from the common memory, the results which the controller of the system B has written, compares the results thus read out with its input results which have been read out from the input unit of the system A, and then carries out comparison with respect to input results between one's own system and other system.

However, the related art involves the following problems. In the conventional multiple redundancy configuration, when obtaining the input results of other system, the controller of one's own system reads out other system read-out results which have been written to the common memory by the controller of other system. With such a configuration, a circuit configuration for realization of a multiple system becomes complicated. Moreover, the complexity of the circuit configuration results in that the data processing becomes complicated, and hence there arises a problem in that an operation speed becomes slow, or the read-out results are delayed. Furthermore, there is encountered a problem in that the system becomes expensive since a dedicated hardware is required.

In addition, in the conventional multiple redundancy configuration, each of the control systems reads out a contact signal obtained through a relay circuit to carry out the comparison and the verification of an ON/OFF state of the contact signal. However, for example, when an encoder is used as signal detecting means, a signal which continuously changes its ON/OFF state is inputted to each of the control systems. As a result, there is encountered a problem in that each of the conventional control systems cannot carry out the comparison and the verification for counting results of such input signals.

DISCLOSURE OF THE INVENTION

The present invention has been made in order to solve the above-mentioned problems, and it is, therefore, an object of the present invention to obtain an elevator controller which is capable of readily carrying out comparison and verification through a multiple system even for an input signal which continuously changes its ON/OFF state.

An elevator controller according to the present invention includes: two or more control systems each having an arithmetic operation processing unit; external clock generating means for realizing synchronization of the arithmetic operation processing units of the control systems; and a common memory data of which can be mutually read out and written between the arithmetic operation processing units of the control systems, in which the arithmetic operation processing unit of each of the control systems, when taking in a pulse train signal used for elevator control as an input signal, takes in both a pulse train signal detected with detection means of one's own system and a pulse train signal detected with detection means of other system as input signals, and when a difference between counting results of the number of pulses of the input signal in both the systems falls within a predetermined input signal allowable error range, executes an arithmetic operation processing required for the elevator control using the input signal from the detection means of a predetermined control system and writes arithmetic operation results to the common memory and reads out the arithmetic operation results in other system from the common memory to obtain a difference between the arithmetic operation results in one's own system and the arithmetic operation results in other system, and when the difference between those arithmetic operation results falls within a predetermined arithmetic operation result allowable error range, judges that the whole control systems are in a normal state and issues a control operation permission command for permitting a control operation for the elevator, while when the difference between both the input signals is beyond the input signal allowable error range, or when the difference between both the arithmetic operation results is beyond the arithmetic operation result allowable error range, the arithmetic operation processing unit of each of the control systems judges that any one of the control systems is in an abnormal state and issues a control operation stop command for stopping the control operation for the elevator.

BEST MODE FOR CARRYING OUT THE INVENTION

Embodiments of the present invention will hereinafter be described based on drawings.

Embodiment 1

In Embodiment 1 of the present invention, a description will be given with respect to a case where a control system able to control an operation of an elevator is constituted by two systems, i.e., a control system a and a control system b.

Figure 1:
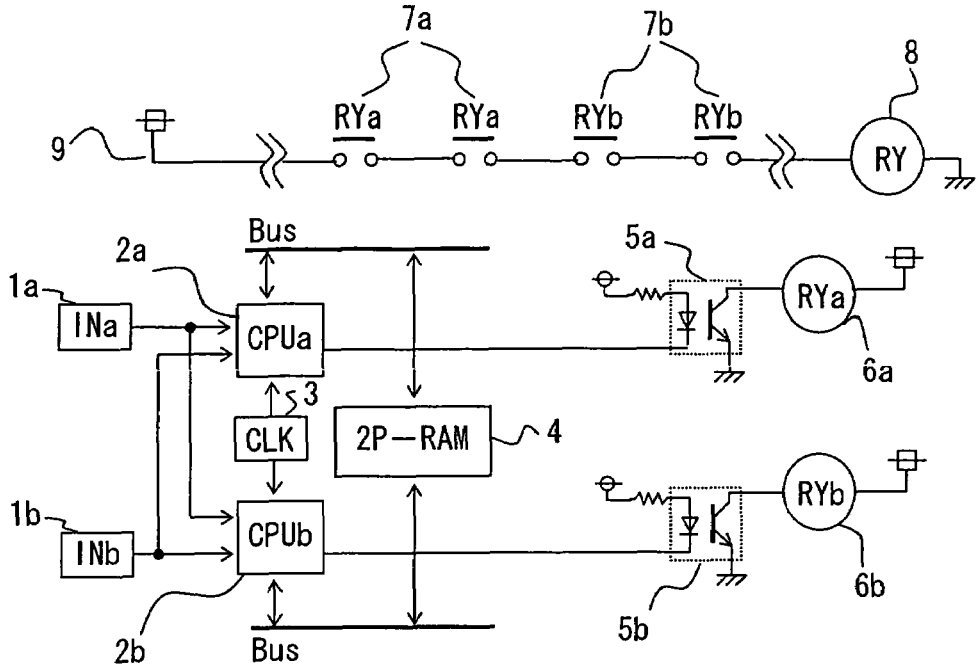
FIG. 1 is a diagram showing a redundancy configuration of a control system of an elevator controller according to Embodiment 1 of the present invention.

FIG. 1 is a diagram showing a redundancy configuration of a control system of an elevator controller according to Embodiment 1 of the present invention. Each of the control systems shown in FIG. 1 has a schematic configuration in which only a microcomputer as an arithmetic operation processing unit is described, and while not illustrated, has a ROM and a RAM as a storage portion. In addition, detectors (not shown) such as encoders are mounted to a shaft of a speed governor of an elevator in order to obtain position/speed information of a car of the elevator. In this embodiment, a case is supposed where signals each having a pulse train from the detectors are respectively inputted to input units 1*a* and 1*b* corresponding to the respective control systems. Moreover, for the purpose of improving reliability, the detectors such as encoders are individually mounted to the respective control systems in order to detect the same signal with a plurality of detection means.

Each of signals which have been supplied through the input units 1*a* and 1*b* from the respective detectors is inputted to both of microcomputers 2*a* and 2*b* of the two systems. The microcomputers 2*a* and 2*b* are synchronized with each other by external clock generating means 3 provided commonly to the microcomputers, and each of the microcomputers executes an input processing and an arithmetic operation processing. The microcomputers 2*a* and 2*b* have event counter registers (not shown) in order to count the numbers of pulses of the input signals each having a pulse train, respectively.

A common memory 4 which is commonly provided as external storage means is connected to each of the microcomputers 2*a* and 2*b* of those two systems. The microcomputers 2*a* and 2*b* can read out and write data from and to the common memory 4 through respective buses. With such a configuration, each of the microcomputers 2*a* and 2*b* can read out the arithmetic operation results in other system.

The microcomputers 2*a* and 2*b* can judge based on the comparison and the judgment for the input signals to both the systems and the arithmetic operation results in both the systems whether or not each of the control systems a and b is in a normal state, i.e., whether or not the control system is in a normal state. Moreover, the microcomputers 2*a* and 2*b* output signals related to their judgment results to photocouplers 5*a* and 5*b*, respectively, thereby allowing ON and OFF states of relay coils 6*a* and 6*b* to be changed over to each other.

A relay contact 7*a* of the relay coil 6*a* and a relay contact 7*b* of the relay coil 6*b* are inserted in series between a relay coil 8 and a control circuit line 9 of the relay coil 8. Here, the relay coils 6*a* and 6*b* and the relay contacts 7*a* and 7*b* correspond to a relay circuit portion.

When even any one of the relay contacts 7*a* and 7*b* becomes the OFF state, the excitation for the relay coil 8 is cut off Accordingly, while not illustrated, for example, a relay contact of the relay coil 8 is inserted into a circuit for cutting off a motor brake power supply for the elevator, whereby a motor can be braked based on outputs from the microcomputers 2*a* and 2*b*.

Figure 2:
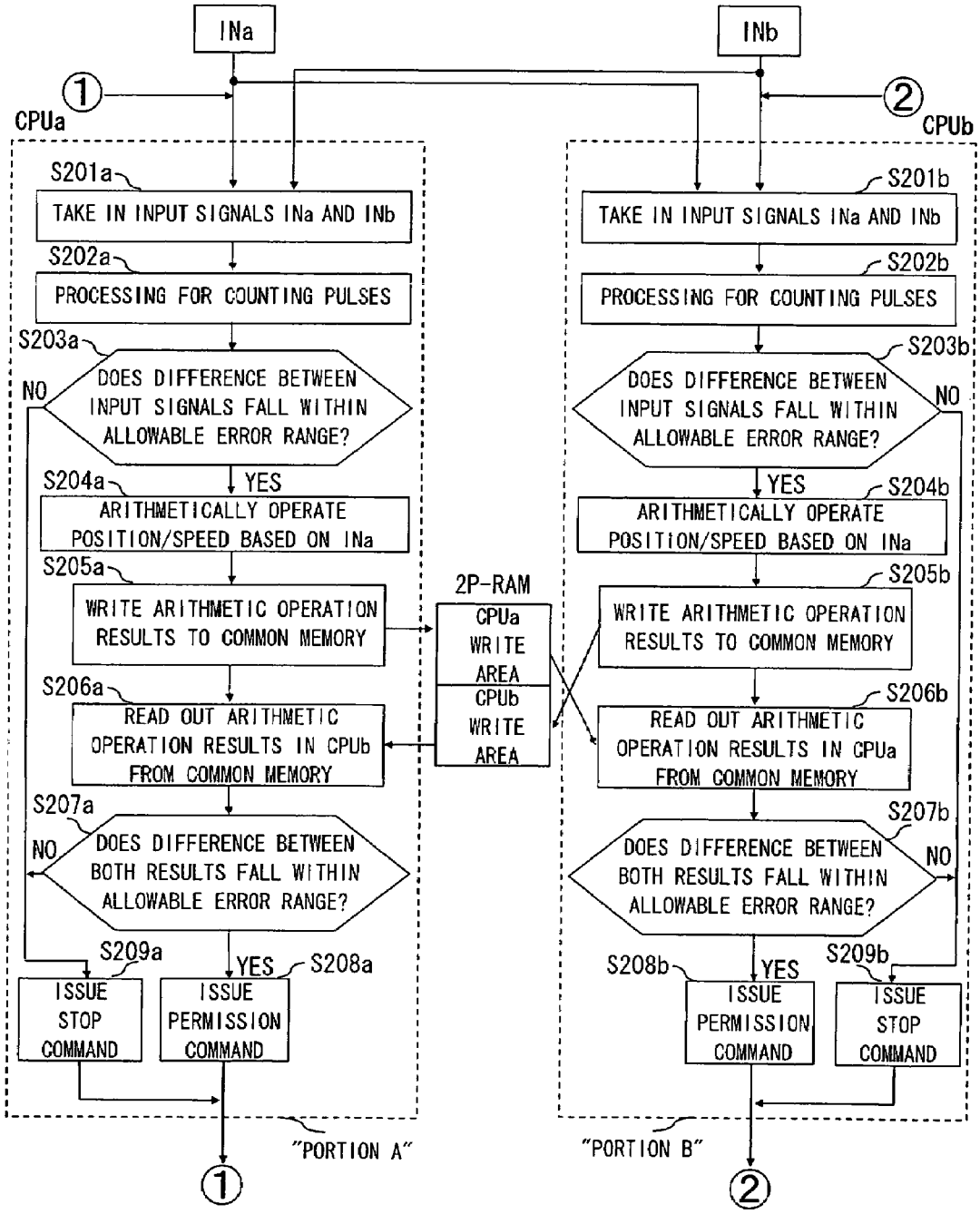
FIG. 2 is a flow chart showing a processing for carrying out judgment with respect to a normal state of the control system in the elevator controller according to Embodiment 1 of the present invention.

Next, an operation will be described in detail with reference to FIG. 2. FIG. 2 is a flow chart showing a processing for carrying out judgment with respect to a normal state of the control system in the elevator controller according to Embodiment 1 of the present invention. Suffixes a and b added to corresponding step numbers represent the control system a and the control system b, respectively, and both the control systems a and b are identical in basic processing to each other. Then, a description will be mainly given with respect to a case where it is judged for the control system a whether or not the control system is in a normal state.

The microcomputer 2*a* of the control system a takes in an input signal INa from one encoder mounted to the shaft of the speed governor of the elevator through the input unit 1*a*. At the same time, the microcomputer 2*a* of the control system a further takes in an input signal INb from the other encoder mounted to the shaft of the speed governor of the elevator through the input unit 1*b* (S201*a*).

The microcomputer 2*a* executes a processing for counting the numbers of pulses of the respective input signals INa and INb using the corresponding event counter register (S202*a*). Moreover, the microcomputer 2*a* reads out the count value from the corresponding event counter register with a constant arithmetic operation period synchronously with the clock signal from the external clock generating means 3.

The microcomputer 2*a* compares the count values with respect to the input signals INa and INb which have been read out from the respective event counter registers with each other. More specifically, the microcomputer 2*a* obtains a difference value between both the count values to judge whether or not the difference value falls within a predetermined input signal allowable error range (S203*a*).

When the difference value falls within the predetermined input signal allowable error range, the microcomputer 2*a* adopts the count value based on the input signal INa as a master and executes a processing for arithmetically operating position data and speed data (S204*a*). Here, which of the count values related to the input signals INa and INb is adopted as the master is previously determined as a rule for the processing judgment commonly to all the microcomputers.

In Embodiment 1, this situation corresponds to that the rule is previously determined in which the count value related to the input signal INa is adopted as the master. Moreover, in the control system b as well, the same processing as that in the control system a is executed. That is, when the difference value falls within the input signal allowable error range (S203*b*), the microcomputer 2*b* adopts the count value based on the input signal INa as the master, too, and executes the processing for arithmetically operating the position data and the speed data (S204*b*).

Moreover, the microcomputer 2*a* writes the resultant arithmetic operation results to the common memory 4 (S205*a*). Likewise, the microcomputer 2*b* writes the resultant arithmetic operation results to the common memory 4 (S205*b*), too. Next, the microcomputer 2*a* reads out from the common memory 4 the arithmetic operation results for the control system b which have been written by the microcomputer 2*b* (S206*a*).

The microcomputer 2*a* compares the arithmetic operation results for the control system a calculated by itself with the arithmetic operation results for the control system b calculated by the microcomputer 2*b*. More specifically, the microcomputer 2*a* obtains a difference value between both the arithmetic operation results to judge whether or not the difference value falls within a predetermined arithmetic operation result allowable error range (S207*a*).

When the difference value falls within the predetermined arithmetic operation result allowable error range, the microcomputer 2*a* judges that both the control systems a and b are in a normal state, i.e., the whole control system is in a normal state. Then, the microcomputer 2*a* issues a control operation permission command to the photo-coupler 5*a* so that the elevator can normally run (S208*a*). Thereafter, the operation of the microcomputer 2*a* proceeds to the operation in a next arithmetic operation period. As a result, the relay coil 6*a* is excited and hence the relay contact 7*a* becomes an ON state. The relay contact 7*a* is held in the ON state as long as the state continues in which the control system is judged to be in the normal state.

On the other hand, when the judgment results show that the difference value between both the input signals is beyond the input signal allowable error range (S203*a*), or when the judgment results show that the difference value between both the arithmetic operation results is beyond the arithmetic operation result allowable error range (S207*a*), the microcomputer 2*a* judges that the control system is not in the normal state. Moreover, the microcomputer 2*a* issues a control operation stop command to the photo-coupler 5*a* in order to stop the elevator (S209*a*). As a result, the excitation for the relay coil 6*a* is cut off, and hence the relay contact 7*a* becomes an OFF state.

Likewise, when the microcomputer 2*b* issues a control operation stop command to the photo-coupler 5*b* (S209*b*), the excitation of the relay coil 6*b* is cut off, and hence the relay contact 7*b* becomes an OFF state. Even any one of the relay contact 7*a* or the relay contact 7*b* becomes the OFF state, thereby cutting off the excitation for the relay coil 8. As a result, the motor brake power supply of the elevator is cut off in conjunction with the issue of the control operation stop command from the microcomputer 2*a* or the microcomputer 2*b*.

According to Embodiment 1, a plurality of microcomputers can individually judge the normal state of the control system, and hence can readily configure the multiple redundancy configuration. Each of a plurality of microcomputers judges whether or not the comparison results related to the input signals are beyond the input signal allowable error range, or whether or not the comparison results related to the arithmetic operation results are beyond the arithmetic operation result allowable error range. Also, each of a plurality of microcomputers issues the control operation stop command based on its judgment results to cut off the motor brake of the elevator, thereby allowing the elevator to stop.

Moreover, the elevator controller according to Embodiment 1 adopts the simple hardware configuration having the external clock and the common memory which are common to a plurality of microcomputers. Hence, there is no need to use the expensive dedicated hardware such as Application Specific Integrated Circuits (ASIC), or a Field Programmable Gate Array (FPGA). Furthermore, with this configuration, for the input signals as well having a pulse train and continuously changing its ON/OFF state, the comparison and the verification can be readily carried out through the multiple system, and in addition thereto, for the arithmetic operation results as well, the comparison and the verification can be readily carried out through the multiple system. As a result, it is possible to obtain the inexpensive elevator controller having the high reliability.

Embodiment 2

Figure 3:
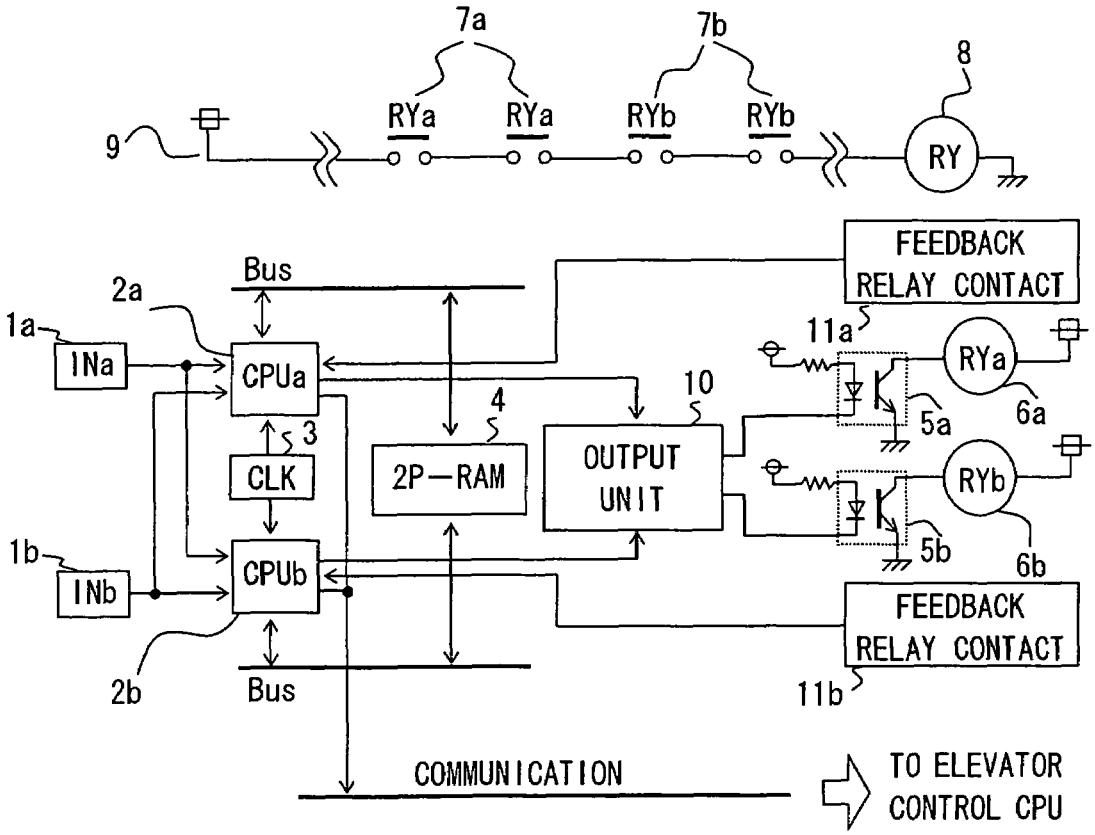
FIG. 3 is a diagram showing a redundancy configuration of a control system of an elevator controller according to Embodiment 2 of the present invention.

In Embodiment 2 of the present invention, a description will be given with respect to a configuration in which the judgment for a normal state of a control system is more strictly carried out. FIG. 3 is a diagram showing a redundancy configuration of a control system of an elevator controller according to Embodiment 2 of the present invention. In comparison with FIG. 1, a point of difference from Embodiment 1 resides in that the control system of the elevator controller further includes an output unit 10 for generalizing command outputs from a plurality of microcomputers, and feedback relay contacts 11*a* and 11*b* through which data related to operation states of relay coils is fed back to the microcomputers, respectively.

The output unit 10 takes in command outputs which have been supplied from the microcomputers 2*a* and 2*b*, respectively, and issues the same generalization commamd to each of the photo-couplers 5*a* and 5*b* based on states of both the commands. In addition, each of the feedback relay contacts 11*a* and 11*b* becomes an OFF state by the excitation for the relay coils 6*a* and 6*b* based on the logic opposite to that in the relay contacts 7*a* and 7*b* each of which becomes an ON state by the excitation for the relay coils 6*a* and 6*b*. The data related to the states of the feedback relay contacts 11*a* and 11*b* is written to the microcomputers 2*a* and 2*b*, respectively. Here, the relay coils 6*a* and 6*b*, the relay contacts 7*a* and 7*b*, and the feedback relay contacts 11*a* and 11*b* correspond to a relay circuit portion.

Figure 4:
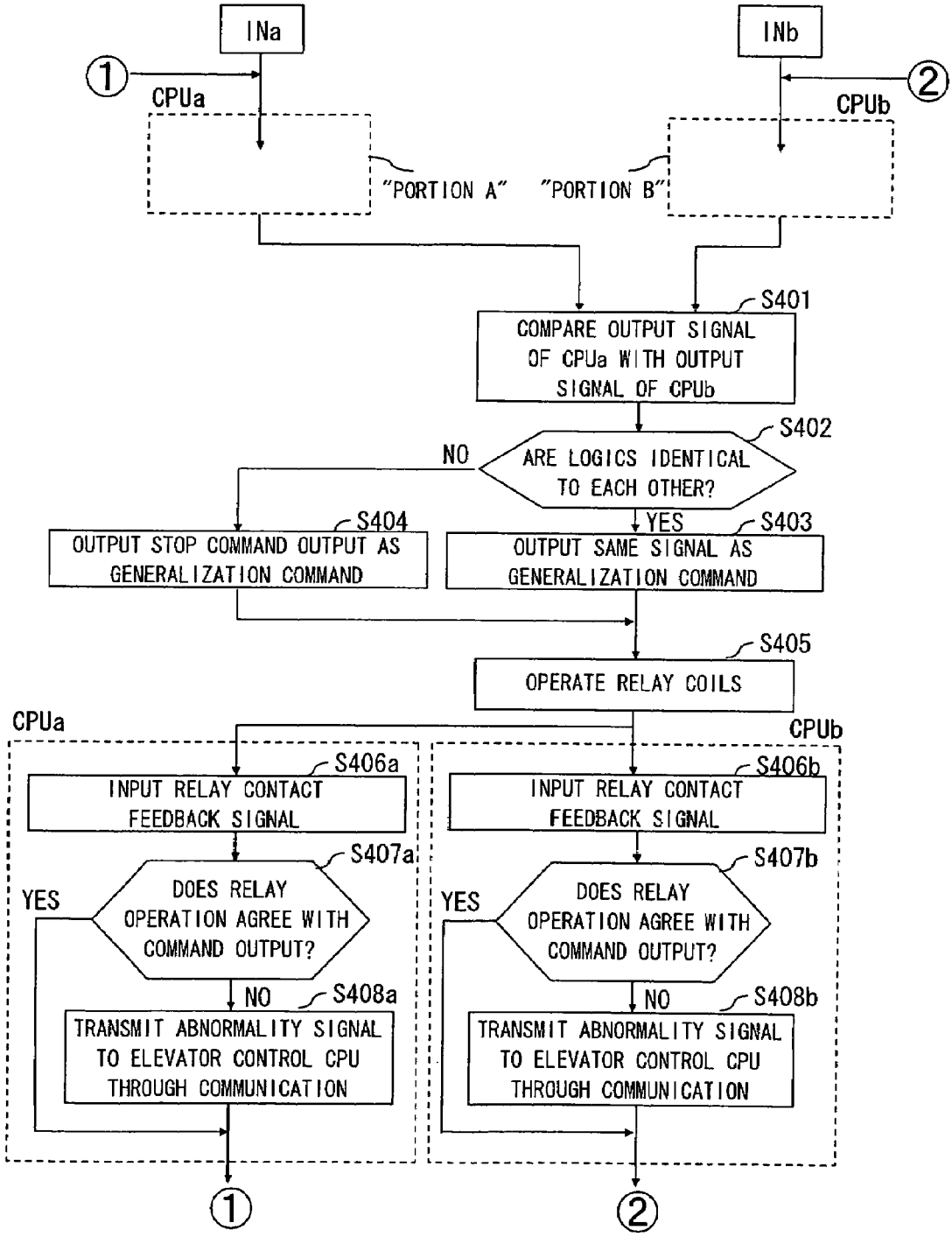
FIG. 4 is a flow chart showing a processing for carrying out judgment with respect to a normal state of the control system in the elevator controller according to Embodiment 2 of the present invention.

The details of the output unit 10, and the feedback relay contacts 11*a* and 11*b* will be described with reference to FIG. 4. FIG. 4 is a flow chart showing a processing for carrying out the judgment with respect to the normal state of the control system in the elevator controller according to Embodiment 2 of the present invention. Suffixes a and b added to corresponding step numbers represent the control systems a and b, respectively, and both the control systems a and b are identical in basic processing to each other. Then, a description will be mainly given with respect to a case where the normal state of the control system is judged in the control system a.

In addition, processings until the microcomputers 2*a* and 2*b* issue the control operation permission commands or the control operation stop commands are completely the same as those in the flow chart shown in FIG. 2. Then, portions used in FIG. 4 are described as "a portion A" and "a portion B" in FIG. 2, and the portions for executing the same processings as those in FIG. 2 are described as "a portion A" and "a portion B" in FIG. 4, and their descriptions are omitted. Processings, after those processings, based on command outputs issued from the microcomputers 2*a* and 2*b*, respectively, will hereinafter be described with reference to FIG. 4.

The output unit 10 takes in command outputs issued from the microcomputers 2*a* and 2*b*, respectively, (S401) to judge whether or not logics of both the command outputs are identical to each other (S402). That is, when the logic of the control operation permission command is assigned 1, and the logic of the control operation stop command is assigned 0, it is judged whether or not the logics of both the command outputs agree with each other. When the judgment results show that the logics of both the command outputs agree with each other, the output unit 10 outputs the agreed command output as the generalization command output to each of the photo-couplers 5*a* and 5*b* (S403).

On the other hand, when the logics of both the command outputs disagree with each other (S402), the output unit 10 outputs the stop command output as the generalization command output to each of the photo-couplers 5*a* and 5*b* (S404). That is, if at least one of the command outputs issued from the respective microcomputers 2*a* and 2*b* is the control operation stop command, the output unit 10 issues the control operation stop generalization command to each of the photo-couplers 5*a* and 5*b*. Moreover, only when both the command outputs issued from the microcomputers 2*a* and 2*b* are the control operation permission commands, the output unit 10 outputs the control operation permission generalization command to each of the photo-couplers 5*a* and 5*b*.

The relay coils 6*a* and 6*b* operate in accordance with the control operation permission generalization command or the control operation stop generalization command issued from the output unit 10 (S405). That is, when the control operation permission generalization command is issued from the control unit 10, each of the relay coils 6*a* and 6*b* becomes an excitation state, while when the control operation stop generalization command is issued from the control unit 10, each of the relay coils 6*a* and 6*b* becomes a non-excitation state.

As described in Embodiment 1, the relay contacts 7*a* and 7*b* are contacts which become an ON state by exciting the relay coils 6*a* and 6*b*, respectively. From a logic opposite to that for the relay contacts 7*a* and 7*b*, the feedback relay contacts 11*a* and 11*b* in Embodiment 2 are contacts which become an OFF state by exciting the relay coils 6*a* and 6*b*, respectively.

The microcomputer 2*a* can detect the ON/OFF state of the relay coil 6*a* by reading out data related to the state of the feedback relay 11*a* (S406*a*). Moreover, the microcomputer 2*a* judges whether or not the read-out state of the feedback relay contact agrees with the state of the command issued to the output unit 10 (S407*a*).

When the judgment results show that both the states agree with each other (S407*a*), the microcomputer 2*a* judges that the normal state of the control system is ensured. Thereafter, the operation of the microcomputer 2*a* proceeds to a next arithmetic operation period. On the other hand, when the judgment results show that both the states disagree with each other (S407*a*), the microcomputer 2*a* judges that the normal state of the control system is not ensured. Then, in order to stop the car, the microcomputer 2*a* transmits an abnormality signal for instructing the elevator control CPU to brake the car using means for communication with a CPU of the elevator control substrate (S408*a*).

Note that in the description of Embodiment 2 described above with reference to the flow chart of FIG. 4, the description has been given with respect to the case where the judgment results show the disagreement in the step number, S407*a*, the microcomputer 2*a* immediately communicates the abnormality signal to the elevator control CPU. However, it is also conceivable that before the microcomputer 2*a* immediately transmits the abnormality signal, the microcomputer 2*a* issues a control operation stop command to the output unit 10. That is, it is tried that the excitation for the relay coil 8 adapted to cut off the motor brake power supply of the elevator is cut off in accordance with the control operation stop command issued from the microcomputer 2*a*, thereby stopping the elevator.

In this connection, the microcomputer 2*a* issues the control operation stop command, and also reads out the signal of the feedback relay contact 11*a*. Next, the microcomputer 2*a* judges whether or not the signal from the feedback relay contact 11*a* is properly detected as being in the ON state in correspondence to the output of the control operation stop command. Then, when the judgment results show that the signal from the feedback relay contact 11*a* is in the OFF state, i.e., a malfunction occurs, similarly to the processing in the former step number, S408*a*, in order to stop the car, the microcomputer 2*a* transmits a signal for instructing the elevator control CPU to brake the car using the means for communication with the CPU of the elevator control substrate.

According to Embodiment 2, the consistency of the control commands issued from a plurality of microcomputers can be more strictly checked by utilizing the output unit and the feedback relay contacts. Moreover, the hardware configuration can be sufficiently realized by using a general-purpose device and the like, and hence is inexpensive in terms of the cost. As a result, it is possible to obtain the inexpensive elevator controller having the high reliability.

As set forth hereinabove, according to the present invention, there is adopted the simple hardware configuration having the external clock and the common memory which are common to a plurality of microcomputers, whereby for the input signal as well having the pulse train and continuously changing its ON/OFF state, the comparison and the verification can be readily carried out through the multiple system, and it is possible to obtain the inexpensive elevator controller having the high reliability.

Note that only while the car is stopped, the microcomputer 2*a* can verify the operation of the feedback relay contact 11*a*. While the car is stopped, even when the ON/OFF operation of the relay coil 8 adapted to cut off the motor brake power supply of the elevator is carried out, there is no hindrance to the operation. Then, the microcomputer 2*a* outputs the control operation permission command or the control operation stop command as a dummy signal for verification of the operation and reads out data related to the state corresponding to this output from the feedback relay contact 11*a*, thereby allowing the operation of the feedback relay contact 11*a* to be verified.

In addition, in Embodiment 2, the configuration has been described in which the output unit and the feedback relay contacts are added to the elevator controller of Embodiment 1. However, it is possible to adopt a configuration in which only the output unit or only the feedback relay contacts is added to the elevator controller of Embodiment 1.

In addition, in Embodiments 1 and 2, the case has been described where the input signals each having the pulse train from the respective encoders are compared with each other based on the allowable error. However, the agreement/disagreement of the input signals used to detect the ON/OFF state can also be simply judged through the comparison.

Also, in FIGS. 1 and 2, a safety relay unit can be used as the relay coils 6*a* and 6*b*, the relay contacts 7*a* and 7*b*, and the feedback relay contacts 11*a* and 11*b*. The safety unit has a function of operating so as to cut off a power supply reliably when the abnormality has occurred, and of not recovering an original state unless a cause of the abnormality is removed. As a result, it is possible to realize the more reliable elevator controller.

The invention claimed is:

1. An elevator controller, comprising:

at least two control systems, each control system having an arithmetic operation processing unit; and a common memory, data of which can be mutually read out and written between the arithmetic operation processing units of the control systems, wherein the arithmetic operation processing unit of each of the control systems, when taking in a pulse train signal used for elevator control as an input signal, takes in both a pulse train signal detected with detection means of one's own system and a pulse train signal detected with detection means of another system as input signals, when a difference between counting results of the number of pulses of the input signal in both of the systems falls within a predetermined input signal allowable error range, executes arithmetic operation processing required for the elevator control using the input signal from the detection means of a predetermined control system and writes arithmetic operation results to the common memory and reads out the arithmetic operation results of another system from the common memory to obtain a difference between the arithmetic operation results in one's own system and the arithmetic operation results in the other system, when the difference between those arithmetic operation results falls within a predetermined arithmetic operation result allowable error range, judges that all of the control systems are in a normal state and issues a control operation permission command for permitting a control operation for the elevator, and when the difference between the input signals is beyond the input signal allowable error range, or when the difference between the arithmetic operation results is beyond the arithmetic operation result allowable error range, the arithmetic operation processing unit of each of the control systems judges that one of the control systems is in an abnormal state and issues a control operation stop command for stopping the control operation for the elevator.

2. The elevator controller according to claim 1, further comprising an output unit for reading out the control operation permission commands or the control operation stop commands issued by the arithmetic operation processing units of the control systems, and for issuing a control operation permission generalization command when reading out the control operation permission commands from the arithmetic operation processing units of all of the control systems, and for issuing a control operation stop generalization command when reading out the control operation stop command from the arithmetic operation processing unit of at least one of the control systems.

3. The elevator controller according to claim 1, wherein the arithmetic operation processing units of each of the control systems reads out a contact signal of a relay circuit portion for carrying out an ON/OFF operation in accordance with the control operation permission generalization command or the control operation stop generalization command, and compares the control operation permission command or the control operation stop command issued to the relay circuit portion, and an ON/OFF state of the contact signal to verify whether or not operation of the relay circuit portion is normal.

4. The elevator controller according to claim 2, wherein the arithmetic operation processing units of each of the control systems reads out a contact signal of a relay circuit portion for carrying out an ON/OFF operation in accordance with the control operation permission generalization command or the control operation stop generalization command issued from the output unit, and compares the control operation permission command or the control operation stop command issued to the output unit, and an ON/OFF state of the contact signal to verify whether or not operation of the relay circuit portion is normal.

* * * * *